US008164239B2

(12) United States Patent
Fujisawa et al.

(10) Patent No.: US 8,164,239 B2
(45) Date of Patent: Apr. 24, 2012

(54) EXCIMER LAMPS

(75) Inventors: Shigeki Fujisawa, Himeji (JP); Yukihiro Morimoto, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 354 days.

(21) Appl. No.: 12/248,453

(22) Filed: Oct. 9, 2008

(65) Prior Publication Data

US 2009/0096343 A1 Apr. 16, 2009

(30) Foreign Application Priority Data

Oct. 10, 2007 (JP) ..... 2007-264275
Jul. 8, 2008 (JP) ..... 2008-177792

(51) Int. Cl.
*H01J 5/16* (2006.01)
*H01J 61/40* (2006.01)
*H01K 1/26* (2006.01)
*H01K 1/30* (2006.01)

(52) U.S. Cl. ..... 313/113; 313/634; 313/635; 313/607; 313/234; 313/498; 313/318.11; 359/201.2; 359/263; 359/359; 359/584

(58) Field of Classification Search ..... 313/635, 313/113, 607, 234, 489, 218.11, 634; 359/201.2, 359/263, 359, 584
See application file for complete search history.

(56) References Cited

U.S. PATENT DOCUMENTS 4,756,968 A * 7/1988 Ebe et al. ..... 428/343
4,965,127 A * 10/1990 Ebe et al. ..... 428/343
5,187,007 A * 2/1993 Ebe et al. ..... 428/343
6,323,585 B1 * 11/2001 Crane et al. ..... 313/112
6,495,844 B1 * 12/2002 Brabham et al. ..... 250/504 R
6,559,598 B2 * 5/2003 Justel et al. ..... 313/587
6,888,312 B2 * 5/2005 Brabham ..... 313/641
6,906,463 B2 * 6/2005 Hildenbrand et al. ..... 313/635
7,057,683 B2 * 6/2006 Udaka et al. ..... 349/96
7,808,170 B2 * 10/2010 Justel et al. ..... 313/486
(Continued)

FOREIGN PATENT DOCUMENTS

JP 2002-93377 A 3/2002
(Continued)

OTHER PUBLICATIONS

European Search Report for Application No. EP 08 01 7647 Dated Feb. 26, 2009.

*Primary Examiner* — Nimeshkumar Patel
*Assistant Examiner* — Thomas A Hollweg
(74) *Attorney, Agent, or Firm* — Roberts Mlotkowski Safran & Cole, P.C.; David S. Safran

(57) ABSTRACT

To avoid a decline in the reflectivity of an ultraviolet reflection film caused by lighting for an extended period of time and providing a uniform illuminance an excimer lamp has a silica glass discharge vessel with electrodes on opposite sides of the discharge vessel, wherein excimer discharge is generated in the discharge space of the discharge vessel, wherein an ultraviolet reflection film made of silica particles and alumina particles is formed on a surface exposed to the discharge space and wherein the mean particle diameter of silica particles is at least 0.67 times as large as the mean particle diameter of the alumina particles. The alumina particles in the ultraviolet reflection film preferably constitute at least 5 wt % and more preferably at least 10 wt % of the sum of silica particles and alumina particles.

4 Claims, 4 Drawing Sheets

U.S. PATENT DOCUMENTS

| | | | | |
|---|---|---|---|---|
| 2001/0024088 | A1* | 9/2001 | Justel et al. | 313/587 |
| 2004/0012753 | A1* | 1/2004 | Udaka et al. | 349/187 |
| 2004/0113558 | A1* | 6/2004 | Brabham | 313/640 |
| 2004/0119083 | A1* | 6/2004 | Su et al. | 257/98 |
| 2004/0198579 | A1* | 10/2004 | Horsfall et al. | 501/4 |
| 2005/0073240 | A1* | 4/2005 | Mayer et al. | 313/489 |
| 2005/0168124 | A1* | 8/2005 | Justel et al. | 313/486 |
| 2005/0242702 | A1* | 11/2005 | Justel et al. | 313/489 |
| 2006/0017366 | A1 | 1/2006 | Hendriks et al. | |
| 2006/0038470 | A1* | 2/2006 | Maul et al. | 313/113 |
| 2006/0135341 | A1* | 6/2006 | Ellison et al. | 501/4 |
| 2006/0141806 | A1* | 6/2006 | Waldfried et al. | 438/778 |
| 2007/0040508 | A1* | 2/2007 | Hsieh et al. | 313/607 |
| 2007/0057612 | A1 | 3/2007 | Hsu et al. | |
| 2008/0061667 | A1* | 3/2008 | Gaertner et al. | 313/113 |
| 2009/0316268 | A1* | 12/2009 | Werdecker et al. | 359/599 |

FOREIGN PATENT DOCUMENTS

| | | | |
|---|---|---|---|
| JP | 3580233 | B2 | 7/2004 |
| JP | 2006-139201 | A | 6/2006 |
| JP | 2007-335350 | A | 12/2007 |
| JP | 2008-66095 | A | 3/2008 |

* cited by examiner

EXCIMER LAMPS

BACKGROUND OF THE INVENTION

1. Field of Invention

The present invention relates to an excimer lamp comprising a discharge vessel made of silica glass having a discharge space, wherein a pair of electrodes is provided on both sides of the silica glass vessel and wherein excimer discharge is generated inside the discharge vessel.

2. Description of Related Art

Various technologies have been developed and put into practical use recently for treating an article made of metal, glass or other materials by means of the action of vacuum ultraviolet radiation with a wavelength of at most 200 nm and ozone generated thereby by radiating the vacuum ultraviolet radiation onto the article to be treated, which includes a cleaning treatment technology for removing organic impurities adhering to the surface of the article and an oxide film formation treatment technology for forming an oxide film on the surface of the article to be treated.

As an example, a device for emitting vacuum ultraviolet radiation is equipped with an excimer lamp as a light source in order to form excimer molecules by means of excimer discharge and uses the radiation emitted from the excimer molecules. Many efforts have been made in order to enhance the intensity of ultraviolet radiation emitted from such an excimer lamp with greater efficiency.

Specifically, as shown in FIGS. 4(*a*) & 4(*b*), an excimer lamp 50 comprising a discharge vessel made of silica glass, which allows passage of ultraviolet radiation, is described, wherein electrodes 55, 56 are provided on the inner side and outer side of the discharge vessel 51 and wherein ultraviolet reflection films are formed on the surfaces exposed to a discharge space S of the discharge vessel 51. An ultraviolet reflection film made only of silica particles and that made only of alumina particles are described as examples in embodiments (See Japanese Patent Publication JP 3580233 B2).

This excimer lamp is provided on part of the discharge vessel 51 with a light exit part 58 from which ultraviolet radiation generated in the discharge space S can exit because the ultraviolet reflection film 20 is not formed on this part.

It is described that an ultraviolet reflection film is provided on the surface exposed to the discharge space S of the discharge vessel 51 in an excimer lamp having the aforementioned configuration, ultraviolet radiation generated inside the discharge space S is reflected by the ultraviolet reflection film, and therefore, does not enter the silica glass in this area in which the ultraviolet reflection film is provided, and ultraviolet radiation passes through the area provided with the light exit 58 to be emitted to the outside, which basically allows effective use of ultraviolet radiation generated inside the discharge space S. Moreover, damage caused by ultraviolet distortion on the silica glass provided in the area other than the light exit part 58 can be minimized, thus preventing the generation of cracks.

However, it was found that there was a problem in excimer lamps equipped with the aforementioned ultraviolet reflection film that the illuminance becomes uneven in the axial direction of the discharge vessel.

SUMMARY OF THE INVENTION

The present invention was devised in view of the aforementioned circumstances. Thus, a primary object of the present invention is to provide excimer lamps that allow a reduction in the extent to which the reflectivity of an ultraviolet reflection film decreases as a result of being operated for an extended period of time and which provides a uniform illuminance in the axial direction of the discharge vessel.

The present invention provides an excimer lamp comprising a discharge vessel made of silica glass having a discharge space, wherein a pair of electrode is provided on opposite sides of the silica glass discharge vessel, wherein excimer discharge is generated in the discharge space of the discharge vessel, wherein an ultraviolet reflection film made of silica particles and alumina particles is formed on the surface exposed to the discharge space and wherein the mean particle diameter of silica particles is at least 0.67 times as large as the mean particle diameter of the alumina particles.

In the excimer lamp according to the present invention, the portion of alumina particles in an ultraviolet reflection film is preferably 5 wt % or more, and more preferably 10 wt % or more of the sum of silica particles and alumina particles.

In the excimer lamp according to the present invention, particle boundaries do not disappear by lighting for an extended period of time because an ultraviolet reflection film is constituted of silica particles and alumina particles, and the silica particles have a specified mean particle diameter relative to the mean particle diameter of the alumina particles. Vacuum ultraviolet radiation can therefore be reflected and diffused efficiently while maintaining the initial reflectivity, and mass difference between the silica particles and the alumina particles caused by a difference in specific gravity can be maintained within a specified range, which allows equalizing the flow properties of the silica particles and alumina particles in a liquid dispersion prepared at the time of forming an ultraviolet reflection film. As a result, the silica particles and alumina particles are evenly dispersed in the ultraviolet reflection film, which allows a uniform illuminance in the axial direction of the discharge vessel to be achieved.

DETAILED DESCRIPTION OF THE INVENTION

Figure 1A:
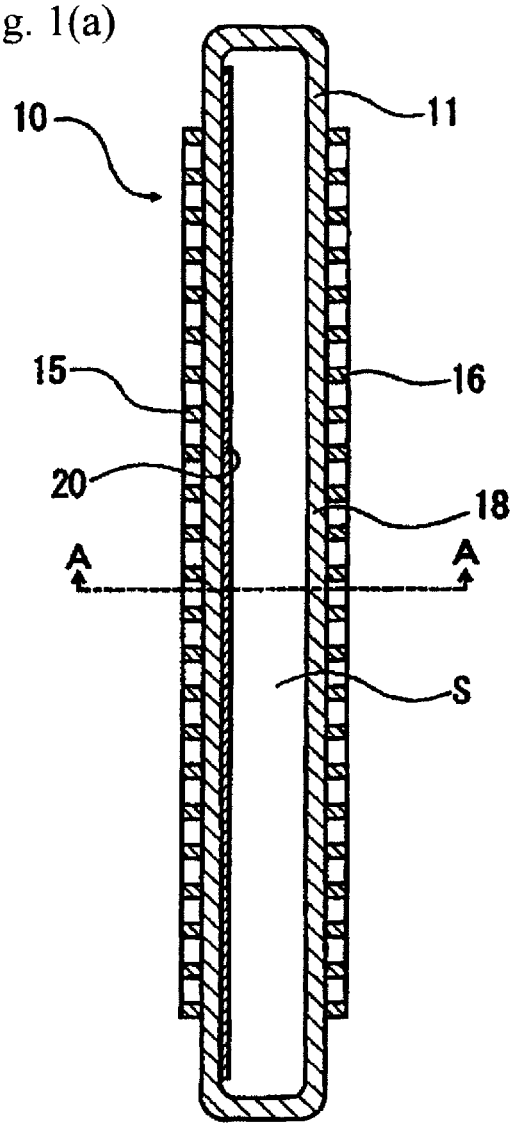
FIGS. 1(*a*) & 1(*b*) are sectional views showing the schematic configuration of an excimer lamp according to one embodiment of the present invention with FIG. 1(*a*) being a cross-sectional view along the longitudinal direction of a discharge vessel and FIG. 1(*b*) being a sectional view taken along line A-A line of FIG. 1(*a*).
Figure 1B:
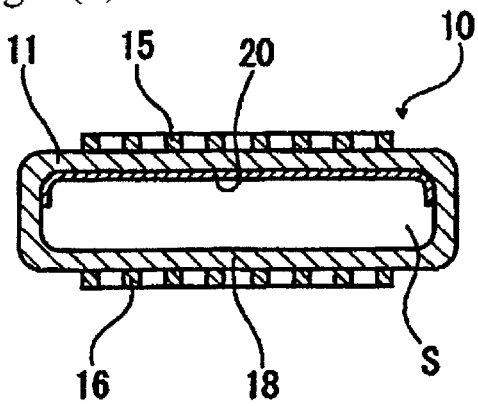

FIGS. 1(*a*) & 1(*b*) are sectional views showing the schematic configuration of an excimer lamp 10 according to an embodiment of the present invention with FIG. 1(*a*) being a cross-sectional view along the longitudinal direction of a discharge vessel and FIG. 1(*b*) being a sectional view taken along line A-A line of FIG. 1(*a*).

Excimer lamp 10 comprises a long and hollow discharge vessel 11 whose cross section is rectangular. Both ends of the discharge vessel 11 are hermetically sealed so that an airtight discharge space is formed inside. The discharge space of the discharge vessel 11 is filled with a discharge gas, such as xenon gas or a mixture of argon and chlorine.

The discharge vessel 11 is made of silica glass (e.g., synthetic quartz glass) that allows the passage of vacuum ultraviolet radiation well and functions as a dielectric.

On the outer surface of the discharge vessel 11 on the long side is provided a pair of electrodes (i.e., an electrode 15, which functions as a high voltage supply electrode, and another electrode 16, which functions as a ground electrode) arranged in such a way as to extend along the long sides of the discharge vessel 11 facing each other, whereby the discharge vessel 11, which functions as a dielectric, is located between the pair of the electrodes 15, 16.

Such electrodes can be formed by paste-coating the discharge vessel 11 with metallic electrode material or by means of a printing operation.

In the excimer lamp 10, discharge occurs between the electrodes 15, 16 via the walls of the discharge vessel 11, which function as a dielectric, after electric power is supplied to the electrode 15. As a result, excimer molecules are formed, and at the same time, excimer discharge occurs so that vacuum ultraviolet radiation is emitted from the excimer molecules. In order to efficiently use the vacuum ultraviolet radiation generated by excimer discharge, an ultraviolet reflection film 20, made of silica particles and alumina particles, is provided on the inner surface of the discharge vessel 11. In the case of using xenon gas as the discharge gas, vacuum ultraviolet radiation having a peak at a wavelength of 172 nm is emitted. In the case of using a mixture of argon and chlorine as the discharge gas, vacuum ultraviolet radiation having a peak at a wavelength of 175 nm is emitted The ultraviolet reflection film 20 is, for example, formed on the inner surface area of the discharge vessel 11 on the long side on which the electrode 15, which functions as the high voltage supply electrode, is provided and continues from the aforementioned inner surface area on the long side onto the inner surface areas of the short sides of the container. The light exit part (aperture part) 18 is formed on the inner surface area of the discharge vessel 11 on the long side on which the other electrode 16, which functions as the ground electrode, is provided by not providing the ultraviolet reflection film 20.

The ultraviolet reflection film 20 is preferably 10 to 100 μm thick, for example.

Since silica particles and alumina particles have a high refractivity and vacuum ultraviolet radiation transmission properties, the ultraviolet reflection film 20 has the function of producing "diffuse reflection", wherein part of the vacuum ultraviolet radiation which has reached the silica particles or alumina particles, is reflected on the surface of the particles and other parts thereof are refracted and incident on the particles, wherein a large portion of the light incident on the particles is transmitted (a portion is absorbed) and refracted again at the time of exiting from the particles, thus repeating reflection and refraction.

Moreover, the ultraviolet reflection film 20 generates no gaseous impurities and can withstand discharge because it is made of ceramic (i.e., silica particles and alumina particles).

The silica particles of the ultraviolet reflection film 20 can be made by pulverizing silica glass into powder.

The particle size of the silica particles, as defined below, is in the range of 0.01 to 20 μm, for example. The mean particle diameter (a peak value of number average particle diameters) is preferably in the range of 0.1 to 10 μm, and more preferably, in the range of 0.3 to 3 μm.

It is also preferable that silica particles having the mean particle diameter account for at least 50% of the silica particles.

The particle size, as defined below, of alumina particles of the ultraviolet reflection film 20 is in the range of 0.1 to 10 μm, for example. The mean particle diameter (a peak value of number average particle diameters) is preferably in the range of 0.1 to 3 μm, and more preferably, in the range of 0.3 to 1 μm.

It is also preferable that alumina particles having the mean particle diameter account for at least 50% of the alumina particles.

The "particle size" of silica particles and alumina particles constituting the ultraviolet reflection film 20 refers to the Feret's diameter, which is an interval between two parallel lines of a specific direction on both sides of any particle on an enlarged projected image, wherein the enlarged projected image is obtained under a scanning electron microscope (SEM) on a broken section obtained by breaking the ultraviolet reflection film 20 perpendicular to its surface direction, wherein the observation range is approximately in the middle position in the thickness direction.

Figure 2A:
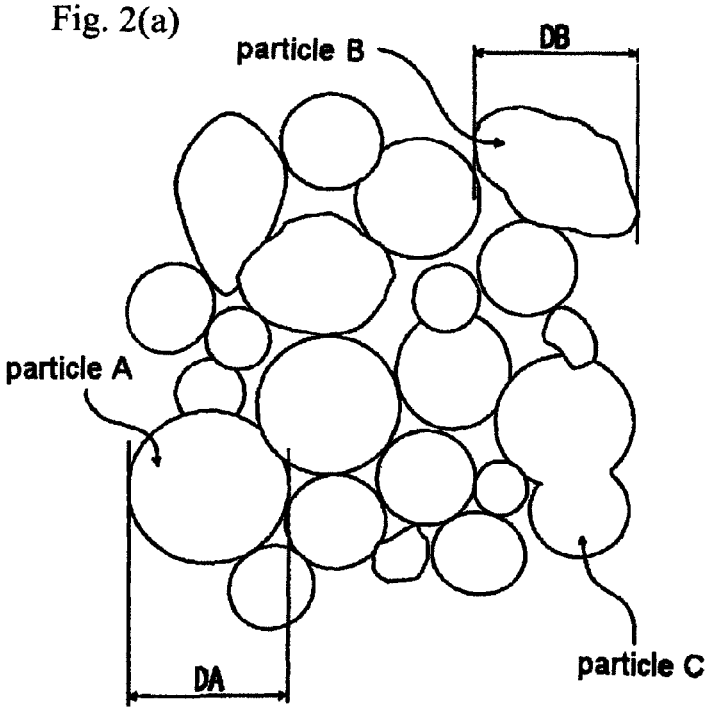
FIGS. 2(*a*) & 2(*b*) are explanatory views showing the definition of the diameters of silica particles and alumina particles.
Figure 2B:
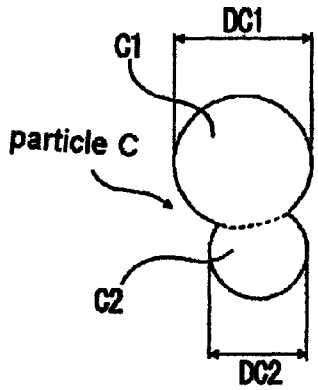

Specifically, as shown in FIG. 2(*a*), the particle size DA or DB is an interval between two parallel lines of a specific direction (e.g., in the thickness direction (the Y-axis direction) of the ultraviolet reflection film 20) on both sides of a substantially spherical particle A or a ground particle shaped particle B, respectively.

In the case of a particle C having a shape formed by melting and then connecting starting particles, as shown in FIG. 2(*b*), the particle size DC1 or DC2 is measured as an interval between two parallel lines of a specific direction (e.g., in the thickness direction (the Y-axis direction) of the ultraviolet reflection film 20) on both sides of the portion which is believed to be the starting particle C1 or C2, respectively.

The "mean particle diameter" of silica particles and alumina particles constituting the ultraviolet reflection film 20 refers to a mean value in a portion in which the number of particles (counted) is maximal, wherein a range between the maximum and minimum values of particle sizes measured as described above is divided into multiple portions (e.g., 15 portions) at intervals of 0.1 μm.

The silica particles and alumina particles having the particle sizes in the aforementioned range that is substantially equivalent to the wavelength of vacuum ultraviolet radiation can reflect and diffuse vacuum ultraviolet radiation efficiently.

The percentage of alumina particles contained in the ultraviolet reflection film 20 of the aforementioned excimer lamp 10 is preferably not less than 5 wt % and not more than 70 wt %, and more preferably, not less than 10 wt % and not more than 70 wt % of die sum of silica particles and alumina particles. This method allows the level of decrease in the reflectivity of the ultraviolet reflection film 20 after lighting for an extended period of time to be reduced and the illuminance to be maintained substantially the same as at the initial time of lighting in the axial direction of the discharge vessel 11 of the excimer lamp 10.

The mean particle diameter of silica particles contained in the ultraviolet reflection film 20 of the aforementioned excimer lamp 10 is preferably not less than 0.67 times as large as the mean particle diameter of alumina particles, and more preferably, not at least 0.67 times and at most 10 times as large as the mean particle diameter of the alumina particles.

As described below, an ultraviolet reflection film can be formed by a "flow-down method," for example. However, since specific gravity is different between silica particles and alumina particles, silica particles, which are smaller in specific gravity, remain on the top edge and alumina particles, which are larger in specific gravity, attach to a discharge vessel on the lower portion at a time when excess liquid (dispersion liquid) is removed by inclining the discharge vessel. If an ultraviolet reflection film is formed by drying and then baking the coating liquid in that state, there occurs a concentration gradient of silica particles and alumina particles. In contrast, mass difference between silica particles and alumina particles caused by the difference in specific gravity can be maintained within a specified range by keeping the mean particle diameter of silica particles within a specified range relative to the mean particle diameter of silica particles, whereby the flow properties of silica particles and alumina particles can be equalized in the dispersion liquid. Thus, silica particles and alumina particles can be evenly dispersed.

In forming the ultraviolet reflection film 20 by the "flow-down method" a liquid dispersion is first prepared by blending silica particles and alumina particles with a viscous solvent of water and PEO resin (polyethylene oxide). This liquid dispersion is poured into the discharge vessel 11 so that it can adhere to a specified portion on the inner surface of the discharge vessel 11. The ultraviolet reflection film 20 can be formed by drying and then baking it so that water and PEO resin can be evaporated. Here, the baking temperature is in the range of 500 to 1100° C., for example.

In the case of forming an ultraviolet reflection film by the flow-down method, the ratio of the mean particle diameter of silica particles to that of alumina particles remains the same as the ratio of mean particle diameters in the starting material. This is confirmed by forming an ultraviolet reflection film on a substrate made of silica glass, peeling the ultraviolet reflection film from the substrate and then measuring the sizes of silica particles and alumina particles by the method described below.

The size of the silica particles can be measured as follows: the ultraviolet reflection film peeled off of the substrate is put in a mixture of 85% phosphoric acid and 97% sulfuric acid, for example; alumina particles are dissolved in a microwave oven; the solution is evaporated by heating; residual silica particles are collected, washed with pure water and dried; and then the particle size is measured under an SEM by the aforementioned method.

The size of alumina particles can be measured as follows: the ultraviolet reflection film peeled off of the substrate is put in 47% hydrofluoric acid for example, in order to dissolve the silica particles; the solution is heated to evaporate the silica component and hydrofluoric acid residual alumina particles are collected, washed with pure water and dried; and then, the particle size is measured under an SEM by the aforementioned method.

Any method can be used for manufacturing silica particles and alumina particles in order to form the ultraviolet reflection film 20, which includes solid liquid and vapor phase processes. Among these, the vapor phase process, and particularly, the chemical vapor deposition process (CVD) is preferred in terms of the production of particles of micron or submicron size without fail.

Specifically, silica particles can be synthesized by reacting silicon chloride with oxygen at 900 to 1000° C. Alumina particle can be synthesized by reacting aluminum chloride with oxygen at 1000 to 1200° C. The particle size can be adjusted by controlling the concentration of raw material, pressure in the reaction area and reaction temperature.

In general, it is well known that plasma is generated from an excimer lamp as a result of excimer discharge. In the excimer lamp having the aforementioned configuration, however, the temperature of an ultraviolet reflection film rapidly increases locally because plasma is incident on the ultraviolet reflection film substantially at a right angle. If the ultraviolet reflection film is made only of silica particles, for example, the silica particles are melted by the heat of the plasma, resulting in the disappearance of particle boundaries. As a result, vacuum ultraviolet radiation cannot be reflected and diffused which leads to a decline in reflectivity.

In the excimer lamp 10 having the aforementioned configuration, since the ultraviolet reflection film 20 is made of silica particles and alumina particles, and the mean particle diameter of the silica particles is within a specified range relative to the mean particle diameter of alumina particles, particles boundaries remain unchanged even if they are heated by plasma. This is because alumina particles, which have a higher melting point than silica particles, are not melted; therefore silica particles and alumina particles that are contiguous to each other cannot be combined. In the case of lighting for an extended period of time, vacuum ultraviolet radiation can be reflected and diffused efficiently, and therefore, the level of the decline in reflectivity can be reduced. Moreover, since the flow properties of silica particles and alumina particles can be equalized by keeping the mass difference of silica particles and alumina particles caused by the difference in specific gravity within a specified range in the liquid dispersion prepared at the time of forming an ultraviolet reflection film, it is possible to form the ultraviolet reflection film in such a way that silica particles and alumina particles are evenly dispersed resulting in a uniform illuminance in the axial direction (e.g., in the inclination direction if an ultraviolet reflection film is formed by the flow-down method) of a discharge vessel.

Moreover, since alumina particles have a higher reflectivity than silica particles, the ultraviolet reflection film according to the present invention can have a higher reflectivity than that made only of silica particles.

Furthermore, the ultraviolet reflection film 20 formed on the inner surface of the discharge vessel 11, which is exposed to the discharge space S where excimer emission is generated, allows reducing die damage caused by ultraviolet distortions arising from vacuum ultraviolet radiation inside the discharge space S, which is incident on silica glass constituting the portion other than the fight exit part 18. Thus, the generation of cracks can be prevented.

A description of embodiments, which were produced to confirm the effect of the present invention, is given below.

<Embodiment 1>

In accordance with the configuration as shown in FIGS. 1(*a*) & 1(*b*), 8 types of excimer lamps were made having the same configuration except that the ratio of the mean particle diameter D1 of silica particles relative to the mean particle diameter D2 of alumina particles (D1/D2) was different in the ultraviolet reflection films as shown in Table 1 below. A description of the basic configuration of the excimer lamps is given below.

(Configuration of Excimer Lamps)

The dimension of the discharge vessel was 10×40×900 mm. The thickness was 3 mm.

The discharge gas filled in the discharge vessel was xenon gas. The amount was 50 kPa.

The size of the high voltage supply electrode and grounded electrode was 30 mm×800 mm.

The emission length of the excimer lamp was 800 mm.

In the ultraviolet reflection film, silica particles having the mean particle diameter account for 50%. Alumina particles having the mean particle diameter also account for 50%.

The size of silica particles and alumina particles was measured using a field emission type scanning electron microscope "S4100" manufactured by Hitachi Ltd. The acceleration voltage was 20 kV. An enlarged projected image was observed with a magnifying power of 20,000 for particles of 0.1 to 1 μm and a magnifying power of 2,000 for particles of 1 to 10 μm.

The ultraviolet reflection film was made by the flow-down method. The baking temperature was 1100° C. The film was 30 μm thick, and the content rate of alumina particles was 10 wt %.

After stabilizing the operational condition by continuously lighting each excimer lamp for one hour under the conditions that the difference in potential becomes 10 kV between the electrodes, the intensity of xenon excimer light with a wavelength of 172 nm was measured at positions 3 mm away in the direction of exiting light and at intervals of 10 mm along the axis of the tube of the discharge vessel and found a relative illuminance based on {(minimum light intensity)/(maximum light intensity)}×100 (%). Table 1 shows the results.

TABLE 1

| | Silica particles | | Alumina particles | | Mean particle | |
|---|---|---|---|---|---|---|
| | Range of particle size [μm] | Mean particle diameter D1 [μm] | Range of particle size [μm] | Mean particle diameter D2 [μm] | diameter ratio D1/D2 | Relative illuminance [%] |
| Excimer lamp 1 | 0.1 to 10 | 3.0 | 0.1 to 1 | 0.3 | 10.0 | 84.2 |
| Excimer lamp 2 | 0.1 to 8 | 1.5 | 0.1 to 1 | 0.3 | 5.00 | 86.0 |
| Excimer lamp 3 | 0.1 to 5 | 1.0 | 0.1 to 1 | 0.3 | 3.33 | 83.6 |
| Excimer lamp 4 | 0.1 to 2 | 0.5 | 0.1 to 1 | 0.3 | 1.67 | 80.0 |
| Excimer lamp 5 | 0.1 to 1 | 0.3 | 0.1 to 1 | 0.3 | 1.00 | 78.3 |
| Excimer lamp 6 | 0.05 to 0.5 | 0.2 | 0.1 to 1 | 0.3 | 0.67 | 73.4 |
| Excimer lamp 7 | 0.01 to 0.2 | 0.1 | 0.1 to 1 | 0.3 | 0.33 | 68.3 |
| Excimer lamp 8 | 0.01 to 0.2 | 0.1 | 0.1 to 1 | 0.4 | 0.25 | 66.9 |

As the product standard, a relative illuminance was required to be not less than 70%. The results shows that the excimer lamps 1 to 6 had a relative illuminance at least 70%, wherein an ultraviolet reflection film was formed by mixing silica particles and alumina particles, wherein the mean particle diameter of the silica particles was not less than 0.67 times as large as that of the alumina particles. Thus, it was confirmed that a uniform illuminance was achievable along the axis of the tube.

<Embodiment 2>

Eight types of excimer lamps having the same configuration as used in Embodiment 1, except that the emission length was 1600 nm and that the ratio of the mean particle diameter D1 of silica particles to the mean particle diameter D2 of alumina particles (D1/D2) was different in the ultraviolet reflection film as shown in Table 2 below. An experiment was conducted in the same manner as in Embodiment 1 to find the relative illuminance of each excimer lamp. Table 2 shows the results.

TABLE 2

| | Silica particles | | Alumina particles | | Mean particle | |
|---|---|---|---|---|---|---|
| | Range of particle size [μm] | Mean particle diameter D1 [μm] | Range of particle size [μm] | Mean particle diameter D2 [μm] | diameter ratio D1/D2 | Relative illuminance [%] |
| Excimer lamp 9 | 0.1 to 10 | 3.0 | 0.1 to 1 | 0.3 | 10.0 | 83.6 |
| Excimer lamp 10 | 0.1 to 8 | 1.5 | 0.1 to 1 | 0.3 | 5.00 | 83.5 |

TABLE 2-continued

| | Silica particles | | Alumina particles | | Mean particle | |
|---|---|---|---|---|---|---|
| | Range of particle size [μm] | Mean particle diameter D1 [μm] | Range of particle size [μm] | Mean particle diameter D2 [μm] | diameter ratio D1/D2 | Relative illuminance [%] |
| Excimer lamp 11 | 0.1 to 5 | 1.0 | 0.1 to 1 | 0.3 | 3.33 | 81.8 |
| Excimer lamp 12 | 0.1 to 2 | 0.5 | 0.1 to 1 | 0.3 | 1.67 | 80.6 |
| Excimer lamp 13 | 0.1 to 1 | 0.3 | 0.1 to 1 | 0.3 | 1.00 | 79.3 |
| Excimer lamp 14 | 0.05 to 0.5 | 0.2 | 0.1 to 1 | 0.3 | 0.67 | 72.1 |
| Excimer lamp 15 | 0.01 to 0.2 | 0.1 | 0.1 to 1 | 0.3 | 0.33 | 65.1 |
| Excimer lamp 16 | 0.01 to 0.2 | 0.1 | 0.1 to 1 | 0.4 | 0.25 | 64.0 |

The results shows, regardless of the emission length of the excimer lamps, that the excimer lamps 9 to 14 had a relative illuminance of at least 70%, wherein an ultraviolet reflection film was formed by mixing silica particles and alumina particles, wherein the mean particle diameter of the silica particles was not less than 0.67 times as large as that of the alumina particles. Thus, it was confirmed that a uniform illuminance was achievable along the axis of the tube.

<Embodiment 3>

Four types of test pieces were produced by forming ultraviolet reflection films of 30 μm on a plate-shaped substrate made of silica glass, wherein the ultraviolet reflection films were made of silica particles and alumina particles, wherein the mean particle diameter (D1) of silica particles was 0.3 μm and the mean particle diameter (D2) of alumina particles was 0.3 μm (D1/D2=1.00), and wherein the content rates of alumina particles were, 0 wt %, 10 wt %. 33 wt % and 50 wt %.

Figure 3:
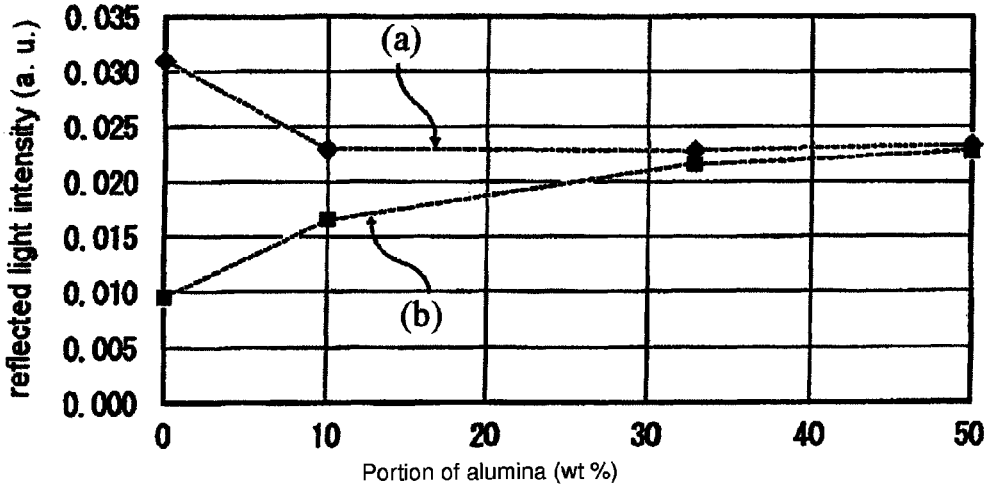
FIG. 3 is a graph showing the intensity of reflected light when the ratio of alumina particles contained in the ultraviolet reflection film of an excimer lamp is changed in the range of 0 to 50 wt %.

Then, the intensity of reflected light with a wavelength of 170 nm was measured for each test piece by heating an ultraviolet reflection film at 1000° C. (as shown by a line (a) in FIG. 3) and by heating it at 1,300° C. (as shown by a line (b) in FIG. 3). FIG. 3 shows the results. Here, 1000° C., which was the heating temperature of the ultraviolet reflection films, corresponded to the baking temperature at the time of forming the ultraviolet reflection films, and 1300° C. corresponded to the heating temperature at a time when plasma acted on the ultraviolet reflection films.

A "VM-502" manufactured by ACTON RESEARCH was used to measure the intensity of reflected light. First a base value of scattered light at each wavelength was obtained for a substrate having no ultraviolet reflection film. Then, a test piece having an ultraviolet reflection film was set and scattered light at each wavelength measured. Each measured value was divided by the base value (i.e., the measured value of a substrate having no ultraviolet reflection film) at each wavelength to find the intensity of reflected light. The intensity of reflected light of 170 nm wavelength was found by selecting the measured value of a specific wavelength from various measured values.

As shown in FIG. 3, the intensity of reflected light was as high as 0.03 or more at 1,000° C. if the content rate of alumina particles in the ultraviolet reflection film was 0 wt % (i.e., in the case of containing no alumina particle). However, the intensity of reflected light markedly declined to approximately 0.01 at 1,300° C. Therefore, it was assumed that the intensity of reflected light declined locally at places where plasma impacted on the ultraviolet reflection film in an excimer lamp, which led to an uneven illuminance in the excimer lamp, and that plasma impacted on the entire area of the ultraviolet reflection if the excimer lamp was fit for an extended period of time, resulting in a decline in reflectivity.

On the other hand, it was confirmed that a decline in reflectivity caused by heating was gradually reduced by adding alumina particles. More specifically, it was confirmed that the intensity of reflected light was lower (e.g., 0.02) at 1,000° C. if 10 wt % of alumina particles was added than that of a film made only of silica particles and that the intensity of reflected light was higher (0.017) at 1,300° C. than that of a film made only of silica particles. Thus, we confirmed that the decline in reflectivity of an ultraviolet reflection film caused by heating could be reduced by approximately 70%.

As the portion of alumina particles increases, the level of a decline in reflectivity of an ultraviolet reflection film caused by heating can be reduced further. For example, if 50 wt % of alumina particles was added, the intensity of reflected light when heated at 1,000° C. agreed with that when heated at 1,300° C., which confirmed that a decline in reflectivity of an ultraviolet reflection film caused by heating could be reduced.

<Embodiment 4>

Multiple types of test pieces were made by forming ultraviolet reflection films of 30 μm on plate-shaped substrates made of silica glass in the same manner as described in Embodiment 3, except fiat the portion of alumina particles was varied in the range of 0 wt % to 10 wt %. Like Embodiment 3, the intensity of reflected light of 170 nm was measured by heating an ultraviolet reflection film at 1,000° C. or 1,300° C. in order to examine the influence of the content of alumina particles on the ultraviolet reflection film Table 3 shows the results. Here, the results in the cases in which the content rates of alumina particles were 0 wt % and 10 wt % were obtained in Embodiment 3 above.

TABLE 3

| Heating temperature of ultraviolet | Intensity of reflected light with a wavelength of 170 nm (a.u.) Content rate of alumina particles [wt %] | | | |
|---|---|---|---|---|
| reflection film [° C.] | 0 | 1 | 5 | 10 |
| 1000 | 0.031 | 0.0280 | 0.0235 | 0.023 |
| 1300 | 0.010 | 0.012 | 0.016 | 0.017 |

As shown in embodiment 4, the intensity of reflected light was lower at 1,000° C. if 1 wt % of alumina particles was added than that of the film made only of silica particles, and the intensity of reflected light was higher (0.012) at 1,300° C. than fiat of fie film made only of silica particles. However, a decline in the reflectivity of fie ultraviolet reflection film could be reduced only by approximately 32%.

In contrast, the intensity of reflected light was lower (e.g., 0.0235) at 1,000° C. if 5 wt % of alumina particles was added than that of the film made only of silica particles, and the intensity of reflected light was higher (0.016) at 1,300° C. than that of fie film made only of silica particles.

Thus, it was confirmed fiat a decline in fie reflectivity of an ultraviolet reflection film could be reduced by approximately 68%.

Accordingly, if 5 wt % of alumina particles is added to an ultraviolet reflection film, a decline in reflectively caused by the melting of silica particles can be reduced in an excimer lamp even though the excimer lamp is operated for an extended period of time to expose the ultraviolet reflection film to fie heat of plasma. It is believed fiat a uniform illuminance can surely be maintained for an extended period time along fie axial direction of fie tube in an excimer lamp provided with the aforementioned ultraviolet reflection film.

It is also believed that fie aforementioned effect can be enhanced by adding 10 wt % or more of alumina particles to an ultraviolet reflection film.

So far, several embodiments of the present invention were explained. However, the present invention is not limited to those embodiments. A wide range of variations are possible.

Figure 4A:
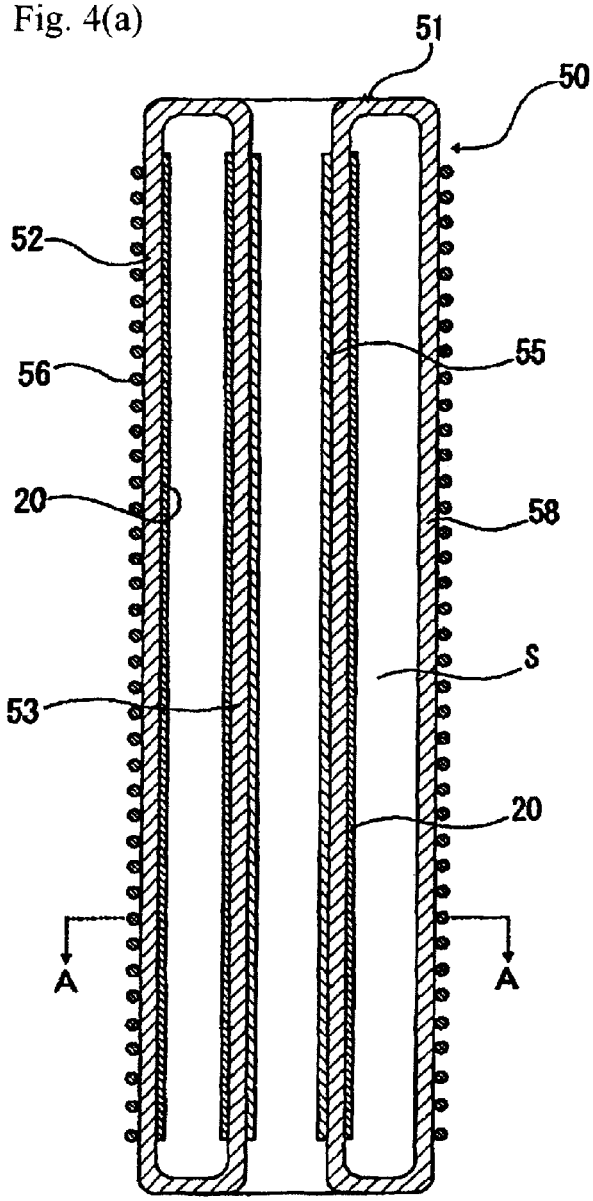
FIGS. 4(*a*) & 4(*b*) are sectional views showing the schematic configuration of an excimer lamp to which another embodiment of the present invention is applicable with FIG. 4(*a*) being a cross-sectional view along the longitudinal direction of a discharge vessel and FIG. 4(*b*) being sectional view taken along A-A fine FIG. 4(*a*).
Figure 4B:
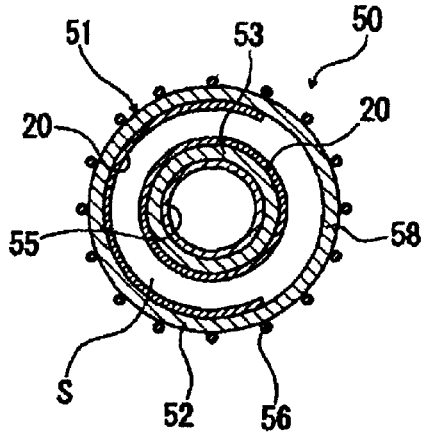
Figure 5A:
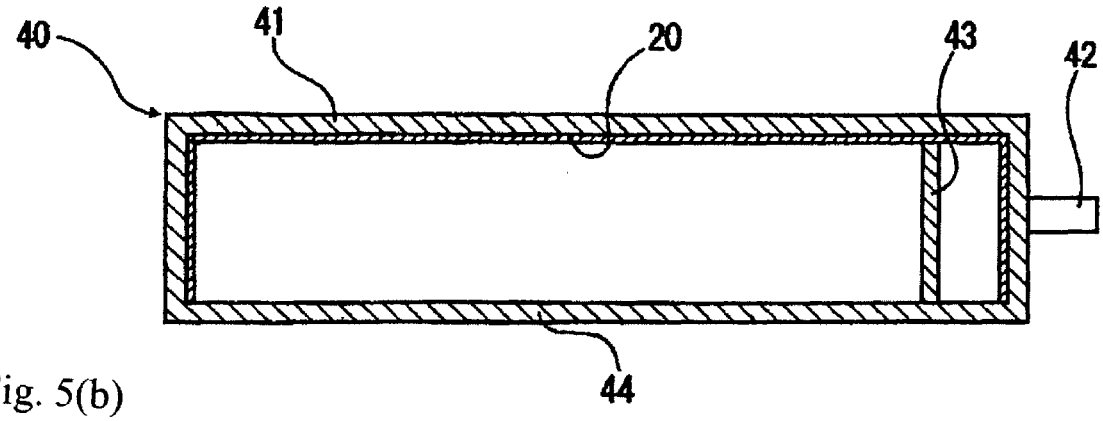
FIGS. 5(*a*) & 5(*b*) are sectional views showing the schematic configuration of an excimer lamp according to yet another embodiment of the present invention with FIG. 5(*a*) being a cross-sectional view along the longitudinal direction of a discharge vessel and FIG. 5(*b*) being a transverse sectional view perpendicular to the plane of the FIG. 5(*a*).
Figure 5B:
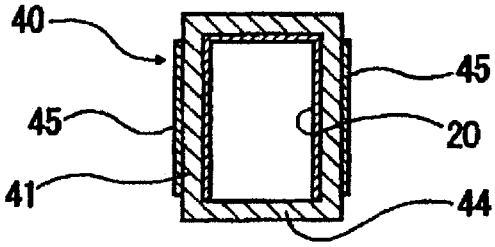

The present invention is not limited to excimer lamps having the aforementioned configuration but can be applied to excimer lamps having a double-tube structure as shown in FIG. 4 and angular-type excimer lamps as shown in FIG. 5.

The excimer lamp 50 as shown in FIG. 4 comprises a circular outer tube 52 made of silica glass and a circular inner tube 53 made of silica glass, for example, which is arranged inside the outer tube 52 along the axis of the tube and has an outside diameter smaller than the inside diameter of the outer tube 52, wherein both edges of the outer tube 52 and the inner tube 53 are fused in such a way as to form a discharge vessel 51 of a double-tube structure having an annular discharge space S between the outer tube 52 and the inner tube 53. An electrode (high voltage supply electrode) 55 made of metal, for example, is closely provided on the inner circumference of the inner tube 53. The other electrode 56 made of conductive material such as metal is closely provided on the outer circumference of the outer tube 52. Inside the discharge space S is filled discharge gas such as xenon gas, which allows forming excimer molecules by means of excimer discharge.

In the excimer lamp 50 having the aforementioned configuration, the aforementioned ultraviolet reflection film 20 is provided on the entire interior surface of the inner tube 53 in the discharge vessel 51. The ultraviolet reflection film 20 is also provided on the interior surface of the outer tube 52 excluding a portion forming a light exit part 58.

The excimer lamp 40 as shown in FIG. 5 comprises a discharge vessel 41 having a rectangular section made of synthetic silica glass, for example. A pair of outer electrodes 45 made of metal is provided on the exterior surface of the discharge vessel 41 facing each other along the axial direction of the tube of the discharge vessel 41. The discharge vessel 41 is filled with discharge gas (e.g., xenon gas). In FIG. 5, the reference numeral 42 is an exhaust tube, and the reference numeral 43 is a getter made of barium, for example.

In the excimer lamp 40 having the aforementioned configuration, the aforementioned ultraviolet reflection film 20 is provided on the inner areas corresponding to the outer electrodes 45 and another inner area, which is connected to the aforementioned areas corresponding to the electrodes, and a light exit part 44 is formed by not providing the ultraviolet reflection film 20.

What is claimed is:

1. An excimer lamp comprising:

a discharge vessel made of silica glass that allows the passage of vacuum ultraviolet radiation having a discharge space, a pair of electrodes, provided on the silica glass at each of opposite sides of the discharge vessel in a manner causing the discharge vessel to function as a dielectric and an excimer discharge producing ultraviolet radiation to be generated in the discharge space of said discharge vessel, and an ultraviolet reflection film made of silica particles and alumina particles formed on a surface of the discharge vessel that is exposed to said discharge space;

wherein the silica particles in the ultraviolet reflection film have a mean particle Feret's diameter that is at least 0.67 times as large as a mean particle Feret's diameter of the alumina particles in the ultraviolet reflection film;

wherein the content of alumina particles in the ultraviolet reflection film is at least 5 wt % of the total weight of the silica and alumina particles.

2. The excimer lamp according to claim 1, wherein the content of alumina particles in the ultraviolet reflection film is at least 10 wt % of the total weight of the silica and alumina particles.

3. The excimer lamp according to claim 1, wherein the mean particle Feret's diameter of the silica and alumina particles in the ultraviolet reflection film is in the range of 0.1 to 10 μm.

4. The excimer lamp according to claim 1, wherein the mean particle Feret's diameter of the silica and alumina particles in the ultraviolet reflection film is in the range of 0.3 to 3 μm.

* * * * *